US009821890B2

(12) United States Patent
Arney et al.

(10) Patent No.: US 9,821,890 B2
(45) Date of Patent: Nov. 21, 2017

(54) CARGO CARRIER

(71) Applicant: Wingman Outfitter, Inc., Roanoke, VA (US)

(72) Inventors: Curtis Drew Arney, Roanoke, VA (US); Austin Gardner Bousman, Vinton, VA (US); Bernard Joe Lipke, Missoula, MT (US)

(73) Assignee: Wingman Outfitter, Inc., Vinton, VA (US)

( * ) Notice: Subject to any disclaimer, the term of this patent is extended or adjusted under 35 U.S.C. 154(b) by 0 days.

(21) Appl. No.: 15/173,442

(22) Filed: Jun. 3, 2016

(65) Prior Publication Data

US 2016/0355237 A1 Dec. 8, 2016

Related U.S. Application Data

(60) Provisional application No. 62/171,877, filed on Jun. 5, 2015.

(51) Int. Cl.
*B63B 35/71* (2006.01)

(52) U.S. Cl.
CPC ..... *B63B 35/71* (2013.01); *B63B 2035/715* (2013.01)

(58) Field of Classification Search
CPC ... B63B 35/71; B63B 2035/715; B63B 17/00; B63B 43/14
See application file for complete search history.

(56) References Cited

U.S. PATENT DOCUMENTS

| | | | | |
|---|---|---|---|---|
| 4,528,925 | A * | 7/1985 | Pyburn | B63B 1/121 114/343 |
| 4,771,722 | A * | 9/1988 | Tihany | B63B 35/73 114/343 |
| 4,773,709 | A * | 9/1988 | Slinkard | B63B 29/04 114/363 |
| 2009/0025624 | A1* | 1/2009 | Boelryk | B63B 43/14 114/364 |
| 2013/0220194 | A1* | 8/2013 | Dupuy | B63B 1/12 114/72 |

* cited by examiner

*Primary Examiner* — Edwin Swinehart
(74) *Attorney, Agent, or Firm* — Quarles & Brady LLP

(57) ABSTRACT

The disclosed invention includes a device that receives and supports one or more storage containers mounted to a water craft. The device includes a frame, secured to the water craft, that includes a center frame and one or more outer frames with a width and length equal to the width and length of one or more complimentary storage containers, which provide equal distribution of weight to the frame to balance and contribute to the buoyancy of the water craft. In some embodiments, the frame may be transformed into a table.

8 Claims, 7 Drawing Sheets

CARGO CARRIER

CROSS REFERENCE TO RELATED APPLICATIONS

This application claims priority to U.S. Provisional Patent Application No. 62/171,877, filed on Jun. 5, 2015, and entitled "CARGO CARRIER."

FIELD OF THE INVENTION

The present invention generally relates to the field of boating and specifically to means for transporting supplies such as coolers for food or dry boxes for camping gear, etc., via a boat or other vehicle, for extended periods of travel.

SUMMARY OF THE INVENTION

The present invention provides a three piece frame that supports 2 cooler/dry boxes on the outside of the canoe or kayak. The coolers can be used for food and beverage or dry storage for camping gear etc., and consists of three main sections in addition to a deck or platform on top. The disclosed invention includes a device that receives and supports one or more storage containers mounted to a water craft. The device includes a frame, secured to the water craft, that includes a center frame and one or more outer frames with a width and length equal to the width and length of one or more complimentary storage containers, which provide equal distribution of weight to the frame to balance and contribute to the buoyancy of the water craft. In some embodiments, the frame may be transformed into a table.

The above features and advantages of the present invention will be better understood from the following detailed description taken in conjunction with the accompanying drawings.

DETAILED DESCRIPTION

Figure 1:
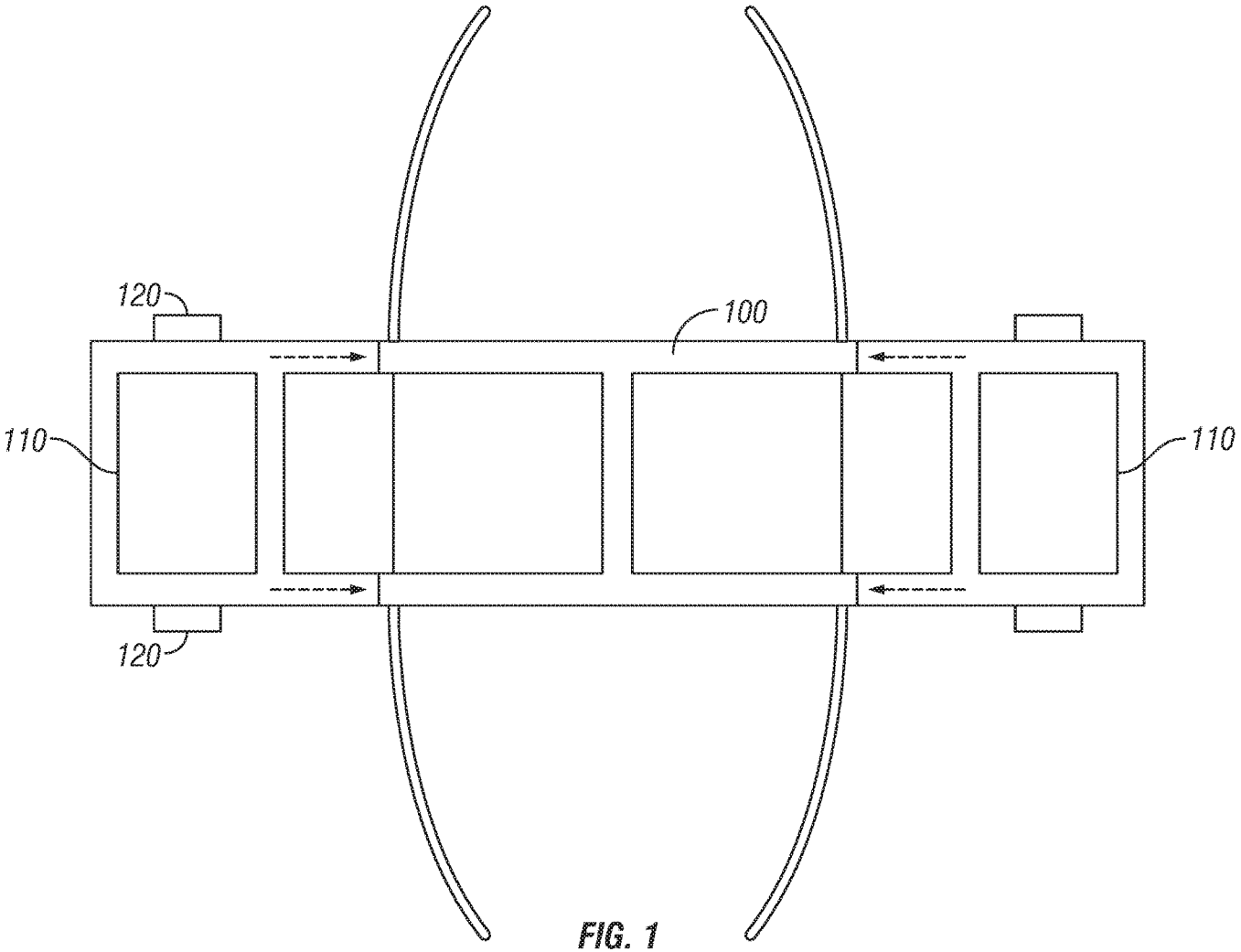
FIG. 1 illustrates a diagram of a top view of the frame of the disclosed invention as it would be mounted to a water craft.

The present invention will now be discussed in detail with regard to the attached drawing figures that were briefly described above. In the following description, numerous specific details are set forth illustrating the Applicant's best mode for practicing the invention and enabling one of ordinary skill in the art to make and use the invention. It will be obvious, however, to one skilled in the art that the present invention may be practiced without many of these specific details. In other instances, well-known machines, structures, and method steps have not been described in particular detail in order to avoid unnecessarily obscuring the present invention. Unless otherwise indicated, like parts and method steps are referred to with like reference numerals.

Water sports are a popular pastime. For example, canoeing, rowing, and kayaking are popular water sports that allow outdoorsmen to travel not only by land, but also across lakes and down rivers. Several types of water crafts may be used for such water sports. For purposes of this disclosure, water crafts may be any type of vehicle used by an operator to travel on water, including, but not limited to, canoes, kayaks, rowboats, and other small water crafts. Often, these types of water crafts only have the cargo capacity for the operator, as well as some additional items, and are therefore only able to carry cargo sufficient for short trips, which may only last a few hours or perhaps even a day.

These types of water crafts are simply not capable of transporting enough cargo to sustain the operator for an extended trip, because they do not currently have the means to transport larger cargo items within one or more storage containers. For purposes of this disclosure, storage containers may include any cargo-carrying containers, such as coolers or dry boxes, as non-limiting examples, used to transport food, camping gear, etc.

Some operators have attempted to overcome the lack of storage for extended trips by simply tying the larger, preferably waterproof storage containers to the smaller water crafts and pulling them behind. However, this solution creates a great deal of drag on the water craft, requiring more effort by the operator to move and maneuver through the water. In addition, turbulent water or other conditions may make it difficult for the operator of the water craft to maintain control because of a loss of balance, buoyancy, or unevenly distributed weight.

The disclosed invention overcomes the weaknesses in the prior art by providing a means for transporting higher volume cargo in multiple storage containers without compromising the minimal space available, while also adding to the buoyancy, balance and weight of the water craft without creating additional drag.

Figure 2:
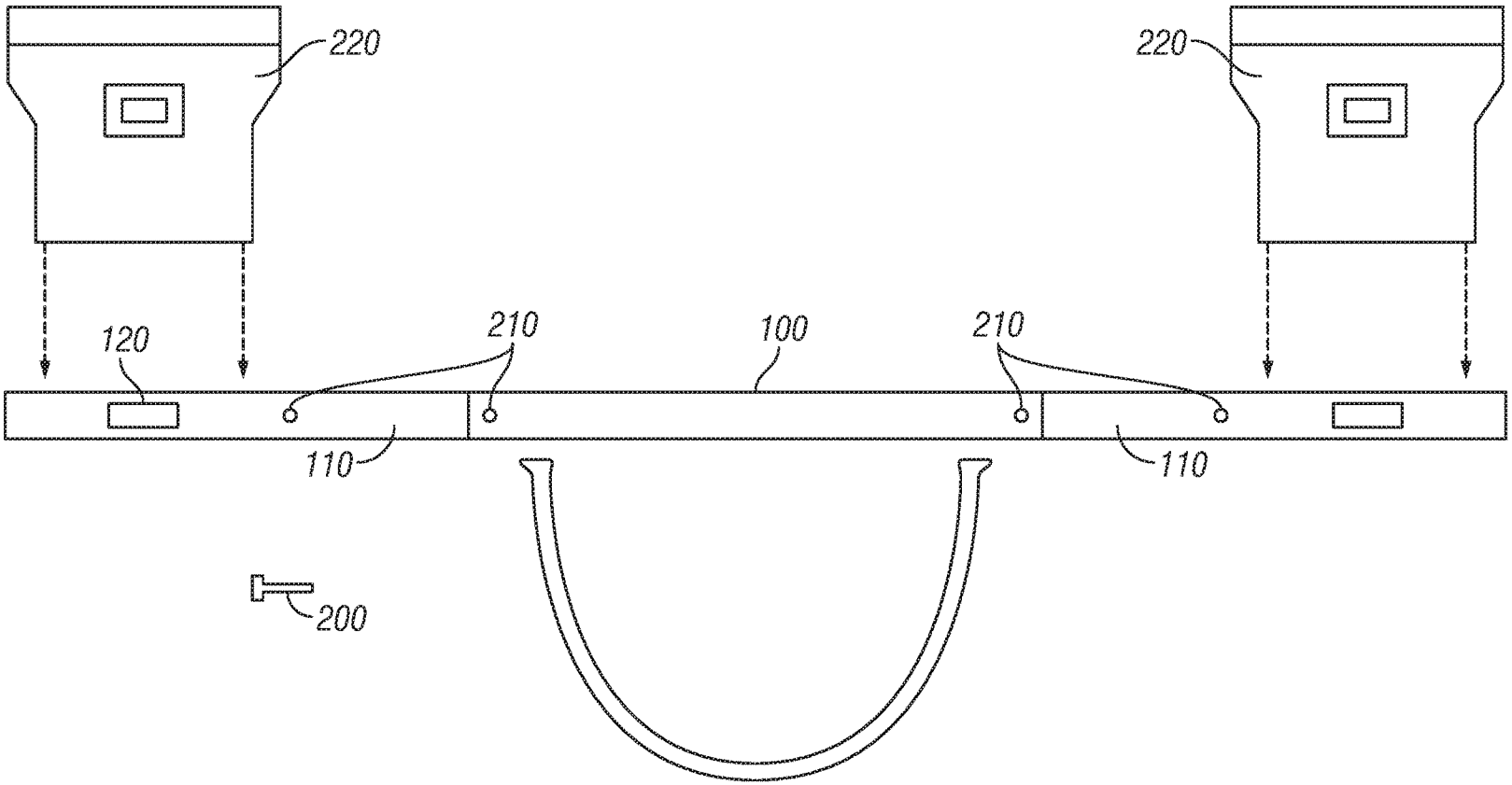
FIG. 2 illustrates a diagram of a side view of the frame of the disclosed invention as it would be mounted to a water craft and further including example storage containers.

FIGS. 1-2 demonstrate the fundamental components of a frame used in the current invention. The frame includes a center frame 100 with two outer frames 110 secured to the center frame.

The center frame 100 may comprise any type of framework capable of interfacing with and/or supporting the one or more outer frames 110 and/or the deck/platform 400 described below. The center frame 100 and/or the outer frames 110 may be manufactured from any material known in the art, including steel, aluminum, molded plastic, wood, etc. In some embodiments, the center frame 100 and outer frames 110 may be made up of square metal tubing. In these example embodiments, the center frame 100 is in the shape of an "H," as seen in FIG. 1. In some embodiments, the square metal tubing may include additional slots formed within the metal tubing (not shown). These slots may be created within the metal tubing in order to accommodate cup holders, fishing rod holders, joysticks for controlling mounted trolling motors, etc.

The two outer frames 110 may be made up of a shape and material that is the same as, or complimentary to, the shape and material of the center frame 100 (e.g., square tubing made from metal, plastic, etc.) with a slightly smaller width, height, length, and/or diameter, so that the two outer frames 110 interface with the center frame 100 by sliding the outer frames' 110 tubing into the framework created by the center frame 100 or vice versa as seen in FIGS. 1-2.

Figure 3:
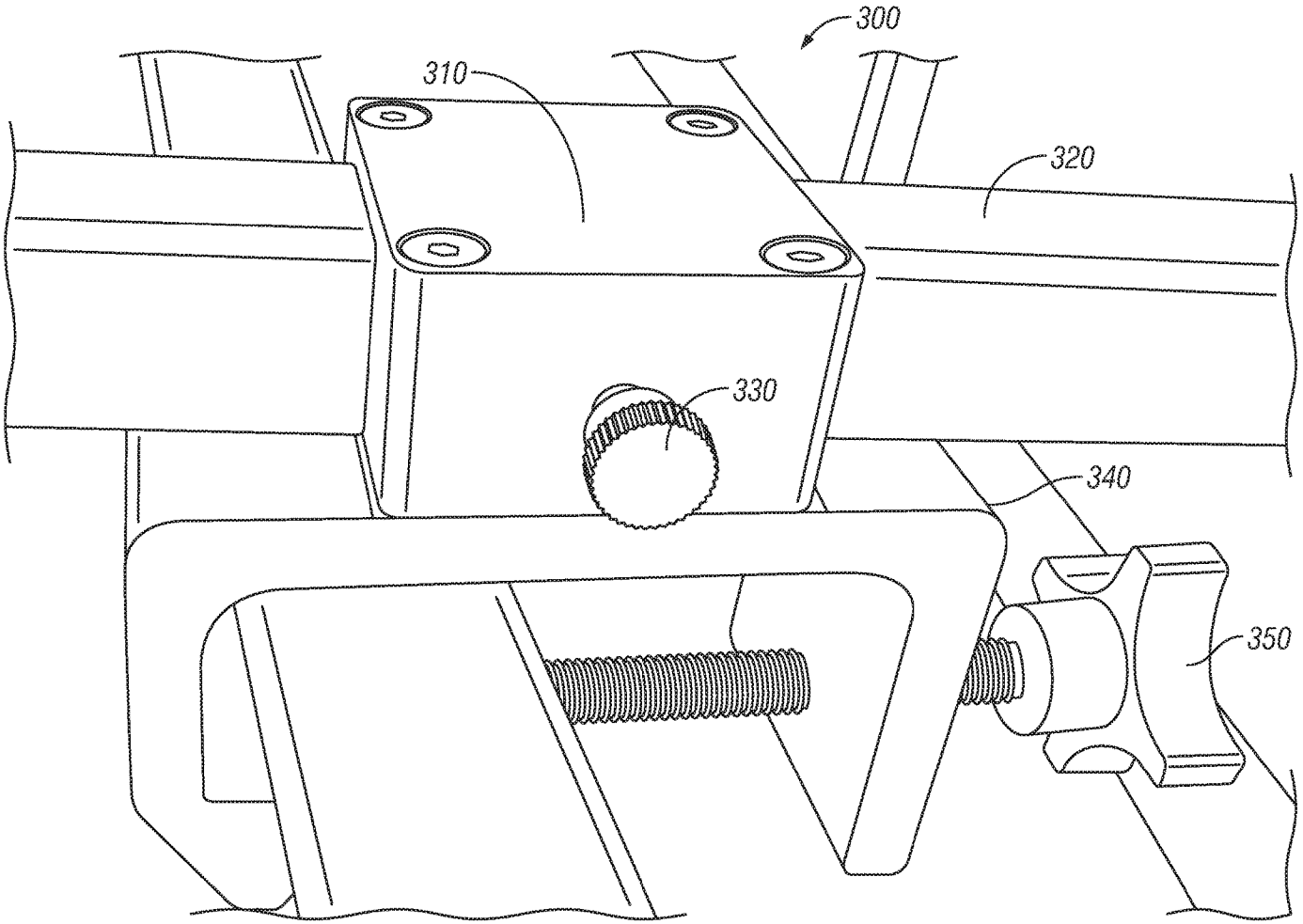
FIG. 3 illustrates a securing mechanism, including a mounting bracket and a clamp used to secure the disclosed invention to a water craft such as a canoe.

FIG. 3 demonstrates a securing mechanism 300 for securing the frame of the current invention to a water craft, or for securing the center frame 100 to the outer frames 110 for use as a table, described in more detail below. Although an exemplary securing mechanism 300 is shown and described herein, this example securing mechanism is non-limiting. Any securing mechanism known in the art for securing the disclosed frame to a water craft, legs of a table, a vehicle, etc. may be used. For example, the center frame 100 may be secured to the water craft by any means known in the art for securing items to the contours of such vessels. FIG. 3 demonstrates a possible means of securing the center frame 100 to the water craft such as a canoe or rowboat (or to the outer frames 110 to convert the frame into a table as disclosed below). In this example, the securing mechanism 300 may include one or more mounting brackets 310 designed to fit over the square tubing 320 of the center frame 100, and secure the center frame 100 to the mounting bracket 310, possibly using the displayed set screw 330. It should be noted that this example is non-limiting. As described in more detail below, other embodiments may exist where straps are used to secure the storage containers to the frame and/or the water craft.

As seen in FIG. 3, the securing mechanism 300 (including the mounting bracket 310 in this example), may also include a clamp 340, possibly tightened via a hand screw 350 as shown in FIG. 3, that secures the mounting bracket 310, or other securing mechanism 300, to the side of the water craft, the legs of a table, a towing mount for a vehicle, etc. In this example, the mounting bracket 310 is secured to the metal tubing and the clamp 340, while the clamp 340 is secured to the side of the water craft.

In this example, the center frame 100 may be mounted to the water craft by placing the center frame (or fully assembled frame) across the boat. Using the disclosed securing mechanism 300, such as the mounting bracket 310 secured to clamp 340 seen in FIG. 3, the center 100 or full frame, including outer frames 110 may be mounted on the water craft by securing the securing mechanism 300, including the displayed mounting bracket 310, to the sides of the water craft.

In each of the possible embodiments, the securing mechanism 300 may allow adjustability for water crafts or other vehicles of all sizes. For example, a mounting bracket 310 may slide along the center frame 100 to allow for such adjustability. Additional embodiments could be imagined in which the securing mechanism 300, including the mounting bracket 310 rotates on the tubing to allow for a significant taper of a canoe's gunwale, or, for example, to a luggage rack on a car.

In some embodiments, such as where a kayak is used, the center 100 or fully assembled frame, including outer frames 110, may rest across the front or back of the kayak as seen in FIG. 4, and may be secured by a series of pull straps and/or ratchet mechanisms, possibly including one or more straps looped around the center frame of the water craft, and/or one or more additional straps securing the center frame 100 to one or more anchor points forward on the kayak, such as handles available to the operator of the kayak. As above, this example is non-limiting, and may include embodiments where straps are used to secure the storage containers to the frame and/or the water craft.

Returning now to FIGS. 1-2, the two outer frames 110 may be secured to the center frame 100 using any tools or techniques known in the art for securing such complimentary frames 100, 110. For example, as seen in FIG. 2, the outer frames 110 may be secured to the center frame 100 using one or more pins 200, which may be inserted into complimentary holes 210 drilled into the top and/or the side of the center 100 and/or outer frames 110.

In this or similar embodiments, multiple holes 210 may be drilled into the outer frames 110, allowing the outer frames 110 to expand or contract the size of the fully-assembled frame according to which holes on the outer frames 110 are matched to the holes in the center frame 100, so that the outer frames 110 may be expanded outward or contracted inward to a user's desired width, thereby creating a telescoping effect This may allow the water craft to become smaller in narrow stretches of river, or to be expanded for greater stability, as non-limiting examples. As in the examples below (in which a platform is secured to the frame), the frame, possibly the center frame 100, may be modified to include one or more push buttons 620 secured to the frame. The outer frames 110 may include holes drilled in the outer frames 110 so that the push buttons 620 may be pushed in, and when released, inserted into the holes within the outer frames 110, thereby securing the outer frame 110 to the center frame 100.

In the non-limiting example embodiments seen in the disclosed figures, the designed frame is made from 1" and ¾" square tubing for the center frame 100 and outer frames 110 respectively. the center frame 100 is made from 1" square tubing and mounts to the top of the water craft and supports the ¾" outer frames 110 that telescope into the 1" center frame 100. The ¾" outer frames 110 are secured to the 1" diameter center frame 100 by securing the pins through a hole in the tubing at the desired width. Any combination of diameters could be used. For example, in some embodiments, the square tubing of the frame could be 1¼ inches. The storage containers 220 can be telescoped out from the water craft for increased stability and deck space or telescoped in towards the water craft for more streamlined paddling.

As seen in FIG. 2, the two outer frames 110 may be designed to provide the support for the storage containers 220. For example, the two outer frames may be custom designed to match the dimensions of the storage containers 220, such as coolers or dry boxes, allowing the storage containers 220 to be simply dropped into the custom built space within the two outer frames. That is, each of the outer frames 110 may comprise a width and length that accommodate the width and length of the storage container 220 that the outer frame 110 will hold.

In some embodiments, the outer frames 110 may comprise materials and/or mechanisms allowing the operator of the water craft to fit the outer frames 110 to the size of the storage container(s) 220, thereby securing each storage container 220 within its respective outer frame 110. In one example embodiment, the outer frames 110 may comprise a combination of straps and ratchets attached, as the outer frame 110, to the center frame 100, thereby allowing the vehicle operator to tighten the straps around the storage container(s) 220. In other embodiments, the outer frames 110 may comprise sides with an adjustable length and width, allowing the operator to adjust the size of the outer frames 110 to match the dimensions of the storage container(s) 220. In embodiments where the storage container(s) 220 comprise a custom-designed slot or hook, the outer. frames 110 may be customized to secure the storage container(s) 220 using these custom-designed slots or hooks.

The design for supporting the storage container(s) 220 is therefore moved outside of the water craft, as well as above the water line, thereby reducing drag on the water craft. For example, the storage container(s) 220 may be transported within the outer frames 110 to the left and right of the vessel with enough clearance above the water line to avoid drag. The storage containers 220 may also be used to improve the stability of the vessel. In these embodiments, as weight is applied to one side of the water craft or the other, the storage container(s) 220 are pushed into the water, which stops the water craft from tipping beyond a stable or controllable point for the operator of the water craft. That is, the storage containers 220 are positioned within the frame to provide an equal distribution of weight to the frame and/or to give the water craft buoyancy in order to balance the water craft. This stability may be analogous to a tight rope walker using a longer and longer pole for greater and greater stability. In a similar manner, the stability of the water craft also comes from the horizontal weight of the cargo outside of the vessel.

Figure 4A:
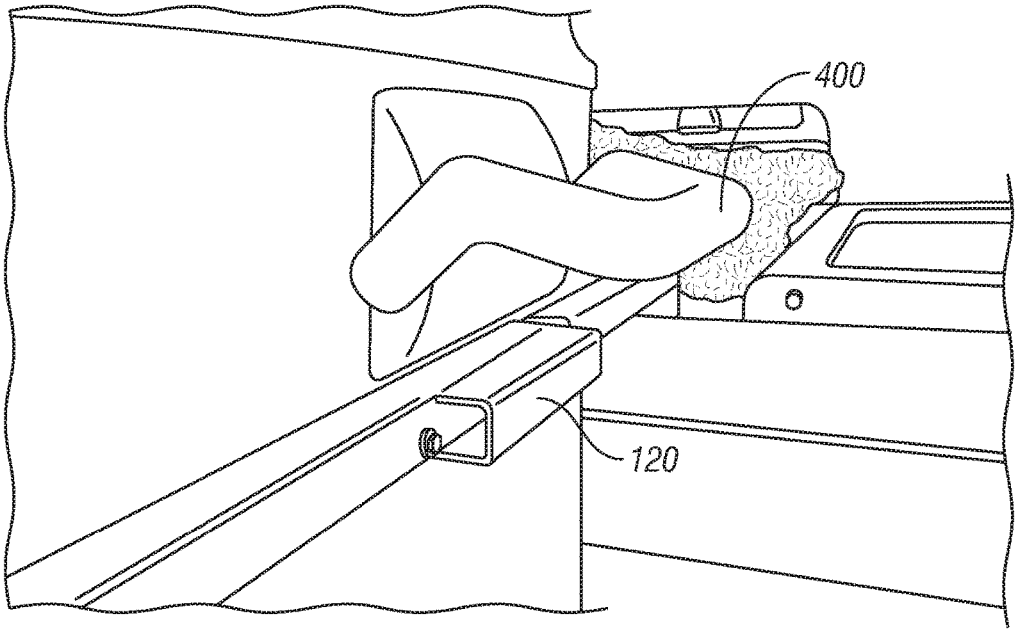
FIGS. 4A-4B illustrate the storage container being secured to frame by closing a handle of the storage container over a protuberance on the frame.
Figure 4B:
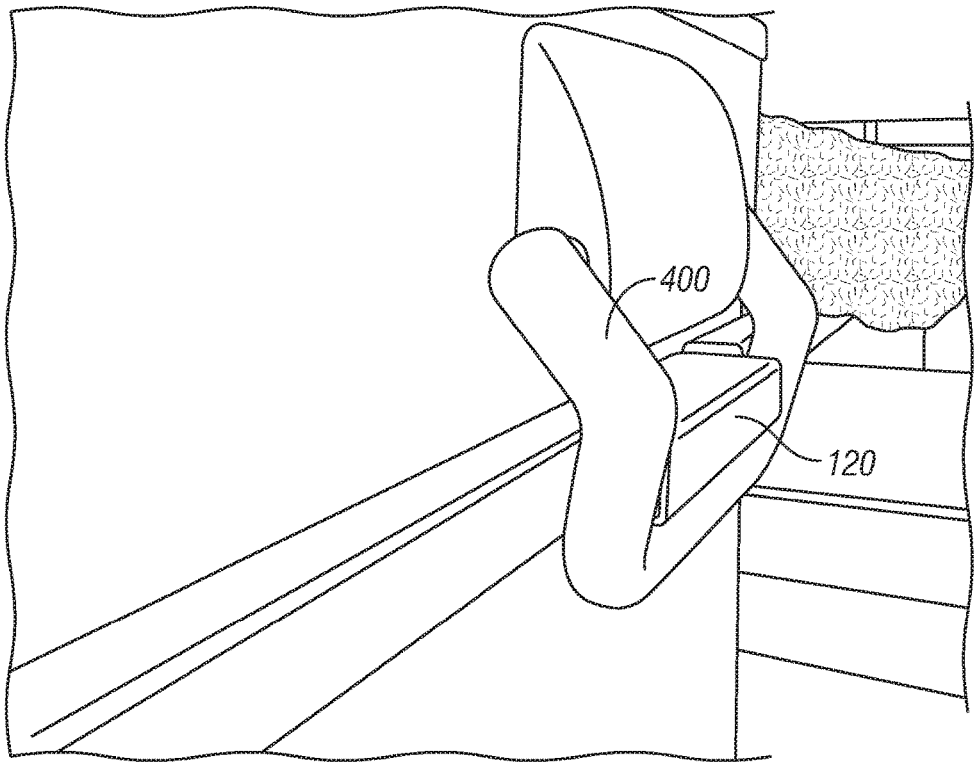

The design of the two outer frames 110, such as the tubing in the disclosed invention seen in FIGS. 1-4, may include one or more protuberances 120 allowing the cargo handles of the storage container(s) 220 to snap onto the outer frame 110 in which the storage container 220 rests, as seen in FIG. 4 in order to prevent the storage container from being lifted out of the outer frame 110 due to the storage container's 220 buoyancy on the water in which it may be resting. As seen in FIGS. 4A-4B, the handle of the storage container(s) 220 may lock into the protuberance 120, preventing the storage container(s) 220 from floating out of their designated holder(s).

Figure 5:
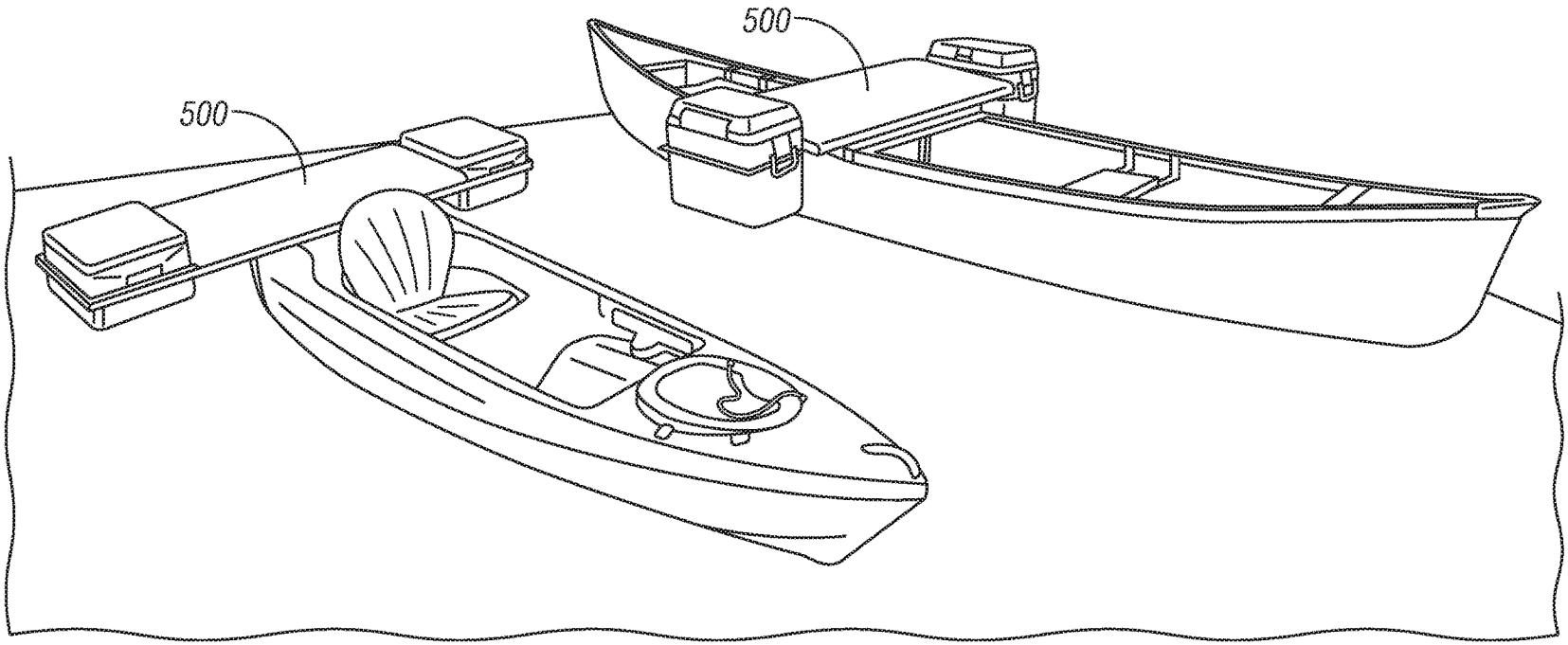
FIG. 5 illustrates the assembled frame and platform secured to a canoe or a kayak.

Once the center frame 100 is secured to the water craft, and two outer frames 110 are secured to the center frame 100, a deck or platform 500, such as that seen in FIG. 5, may be secured to the completed frame, using any means of securing known in the art and may comprise a platform 500, ideally capable of supporting the weight of a person or a pet. The deck or platform may be made of any material, possibly comprising, as non-limiting examples, a custom injected molded plastic, steel, aluminum, wood, etc. The platform 500 may also include a rubber mat or carpet.

The expansion and contraction of the frame from the telescoping effect described above may allow for a longer or shorter platform 500. Non-limiting examples of applications for such platforms 500 may include means for a pet to move around and rest comfortably on the deck. A person may also have a comfortable place to stand while fishing, and thus may improve casting capabilities and have a greater vantage point for seeing good fishing holes etc. Children may also sit and play safely and comfortably on the platform 500.

Figure 6:
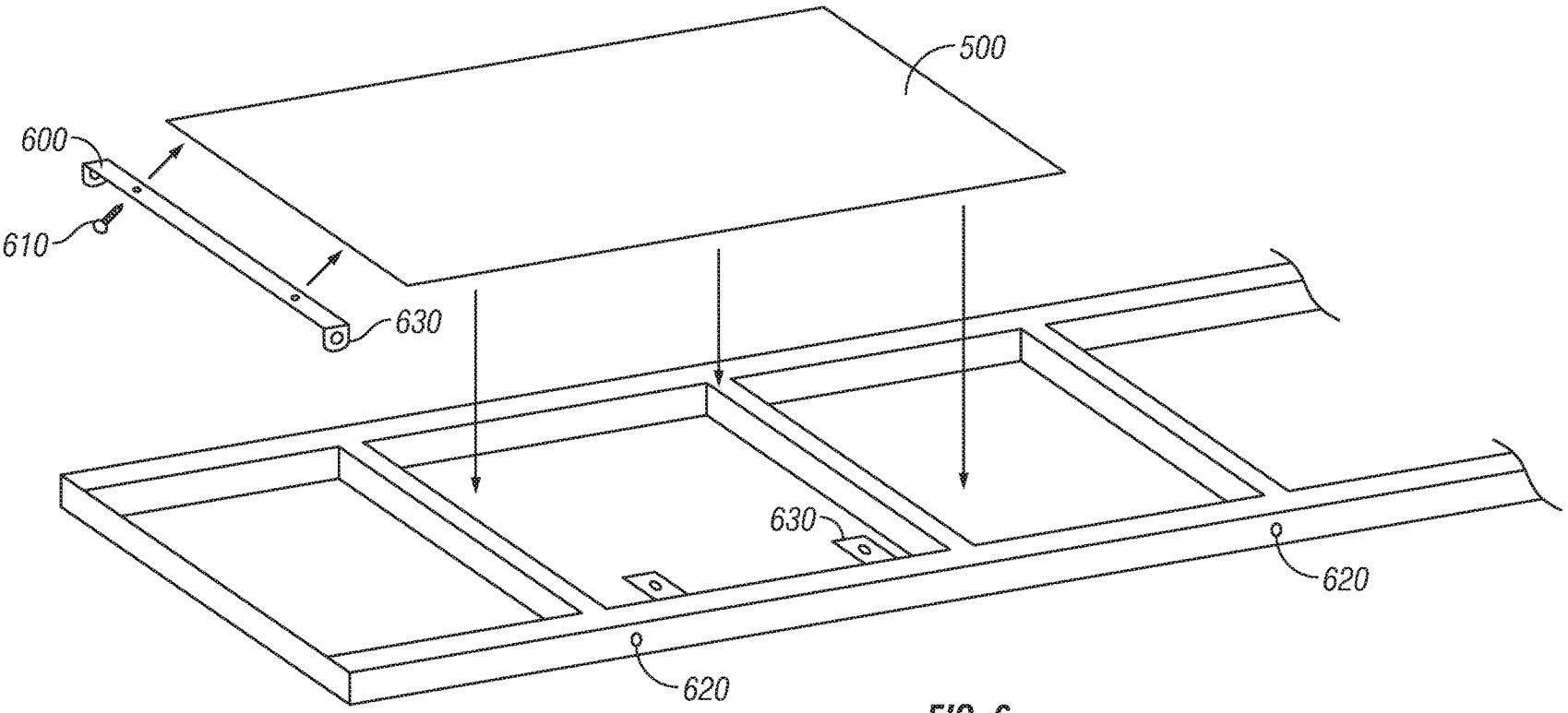
FIG. 6 illustrates an example approach for securing the platform to the frame.

Any securing means known in the art may be used to secure the platform 500 to the frame. In the non-limiting example embodiment seen in FIG. 6, a bracket 600 may be secured to the platform 500, possibly using bracket screws 610 drilled through holes in the bracket 600. The frame, possibly the center frame 100, may be modified to include one or more push buttons 620 secured to the frame. The bracket 600 may bend at the ends to fit flush around the outside edge of the frame, and holes in the bent portion of the bracket 600 may be created within the bracket 600 so that the push buttons 620 may be pushed in, and when released, inserted into the holes 630 of the bracket 600 as the platform 500 is rested on the frame, thereby securing the platform 500 to the frame.

Additionally, or in other embodiments, one or more weld tabs 630 may be secured to the inside of the frame, and the platform 500 may be secured to the frame by threading an attaching device such as a bolt/nut, screw, etc. through the hole and into the platform 500. Additional embodiments could be imagined in which the platform 500 is designed from molded plastic that includes a built-in frame.

Figure 7:
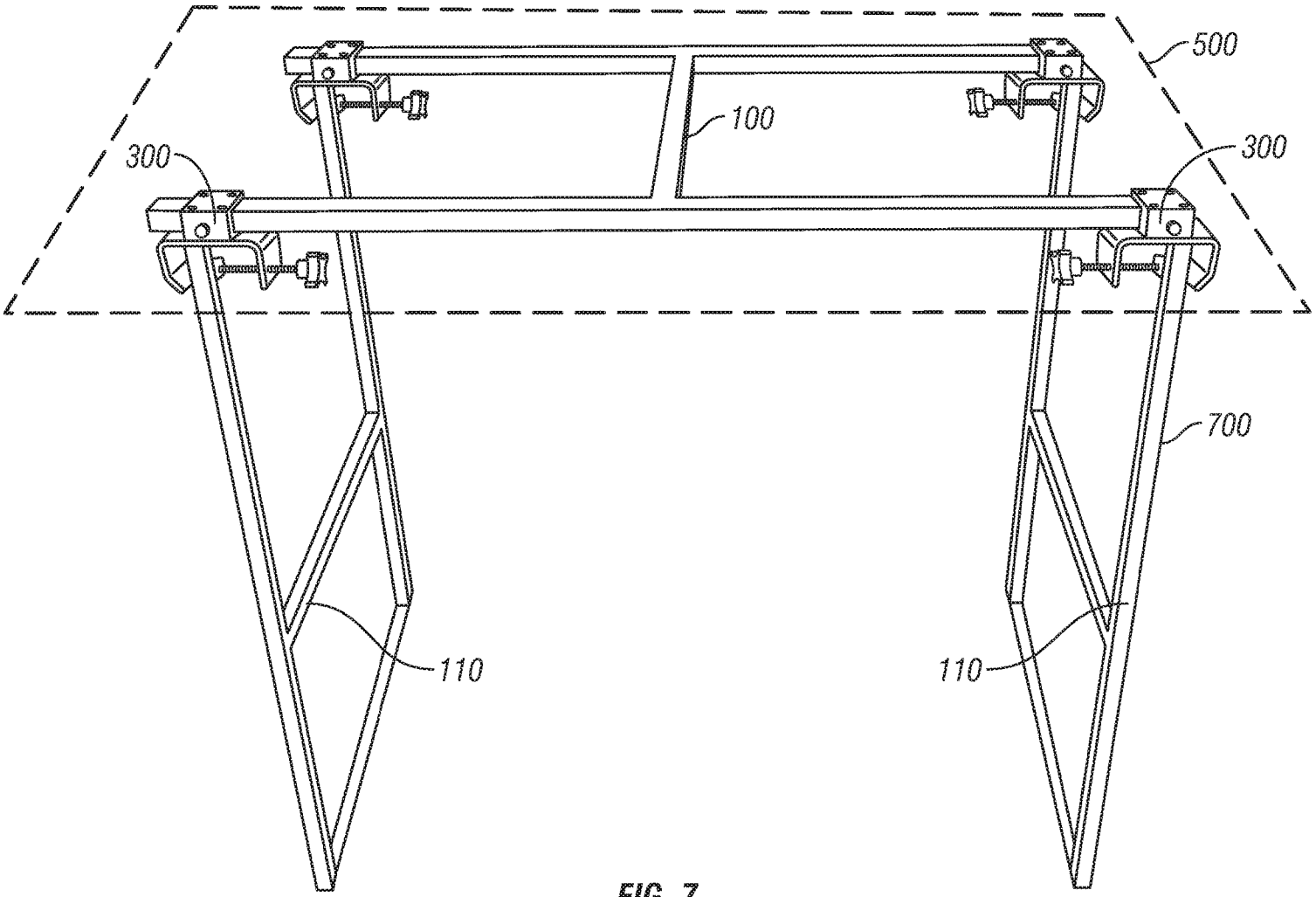
FIG. 7 illustrates the clamp being used to secure the outer frames of the disclosed invention as table legs in order to convert the disclosed invention into a table.

Turning now to FIG. 7, the frame and platform 500 may also be used as a table 700, for example, a camping table. When not being used on the water craft, the center frame 100 may support the platform 500, and the outer frames 110 may be adjusted downward to act as the legs for the table 700 as seen in FIG. 7. As seen in FIG. 7, the securing mechanism 300 may secure the center frame 100 to the bracket(s) as previously disclosed, possibly using the disclosed set screw 330 and/or hand screw 350. The outer frames 110 may be adjusted vertically and attached to the bracket using the clamp 340 in a similar manner as that used to secure the clamp 340 to the side of the water craft, as demonstrated in FIG. 3. Having established the frame for the table 700, the deck/platform 500 may rest or be secured on top, forming the top of the table 700.

Many accessory ideas could also be conceived for the disclosed invention. For example, one or more trolling motors could be mounted to the frame using clamps 340 similar to those disclosed above. These trolling motors may be controlled by a joystick. In other embodiments, an attachment may be custom designed for the completed frame, so that the disclosed invention becomes a platform mounted on the back of a vehicle such as a car or truck.

Other embodiments and uses of the above inventions will be apparent to those having ordinary skill in the art upon consideration of the specification and practice of the invention disclosed herein. The specification and examples given should be considered exemplary only, and it is contemplated that the appended claims will cover any other such embodiments or modifications as fall within the true scope of the invention.

The invention claimed is:

1. A device configured to receive and support at least one storage container mounted to a water craft, the device comprising:

a frame comprising at least one outer frame and a center frame, wherein:

the at least one outer frame comprises a first width and a first length accommodating a second width and a second length of the at least one storage container; and the frame is secured to the water craft, and wherein:

the at least one storage container is positioned within the frame to provide an equal distribution of weight to the frame, thereby balancing the water craft; and the at least one storage container contributes to the buoyancy of the water craft; and, the frame is transformed into a table, wherein:

the center frame is secured to the outer frame, using a mounting bracket and a clamp, to form a table frame; and a platform rests on top of the table frame to form a table surface.

2. The device of claim 1, wherein the at least one storage container comprises a cooler or a dry box.

3. The device of claim 1, wherein the frame is manufactured from steel, aluminum or molded plastic.

4. The device of claim 1, further comprising:

a platform configured to support weight, the platform being secured:

to the top of the frame; and to the water craft using a securing mechanism comprising:

a mounting bracket secured to the center frame using a set screw; and a clamp attached to the mounting bracket and secured to the water craft using a hand screw.

5. The device of claim 1, wherein:

the water craft comprises a kayak; and the frame is secured to the kayak using a securing mechanism comprising:

a series of pull straps looped around the kayak, and ratchet mechanisms; and at least one additional strap securing the center frame to one or more anchor points on the kayak.

6. The device of claim 1, wherein the outer frame is secured to the center frame using at least one pin inserted into at least one hole in the center frame and the at least one outer frame.

7. The device of claim 1, wherein the platform is manufactured from steel, aluminum, molded plastic or wood.

8. The device of claim 1, wherein the platform includes a rubber mat or carpet.

* * * * *